US005102532A

United States Patent [19]

Hautala et al.

[11] Patent Number: 5,102,532

[45] Date of Patent: Apr. 7, 1992

[54] METHOD FOR CONTROLLING PRESSURIZED SCREENING DEVICES AND PRESSURIZED SCREENING DEVICE

[75] Inventors: Jouko Hautala; Juhani Ahonen; Veli-Matti Rajala, all of Tampere, Finland

[73] Assignee: Oy Tampella Ab, Tampere, Finland

[21] Appl. No.: 533,432

[22] Filed: Jun. 5, 1990

[30] Foreign Application Priority Data

Jun. 5, 1989 [FI] Finland ..... 892736

[51] Int. Cl.[5] ..... D21D 5/00; B07B 1/04

[52] U.S. Cl. ..... 209/273; 209/380; 162/55

[58] Field of Search ..... 209/273, 306, 380, 270; 210/413–415; 162/55

[56] References Cited

U.S. PATENT DOCUMENTS

| | | | |
|---|---|---|---|
| 868,341 | 10/1907 | Holden | 209/273 |
| 1,145,097 | 7/1915 | Thoresen et al. | 209/273 |
| 1,856,176 | 5/1932 | Trimbey | 209/273 |
| 3,223,239 | 12/1965 | Dick | 209/270 |
| 3,786,918 | 1/1974 | Holz | 209/273 |
| 3,849,302 | 11/1974 | Seifert | 209/273 |
| 4,105,543 | 8/1978 | Seifert | 209/273 |
| 4,268,381 | 5/1981 | Hooper | 209/273 |
| 4,697,982 | 10/1987 | Hooper | 209/273 X |
| 4,919,797 | 4/1990 | Chupka et al. | 209/273 |

FOREIGN PATENT DOCUMENTS

| | | |
|---|---|---|
| 2820 | 6/1907 | Finland . |
| 56415 | 3/1974 | Finland . |
| 70059 | 4/1980 | Finland . |

*Primary Examiner*—Donald T. Hajec

*Attorney, Agent, or Firm*—Pollock, Vande Sande & Priddy

[57] ABSTRACT

The invention relates to a method for controlling pressurized screening devices in which fiber pulp is fed to the pressurized screening device and is divided into the accepted portion of the fiber pulp passing through perforations of a cylindrical screenplate and the rejected portion which is removed from the screenplate, the perforated screenplate being treated by a device movable relative thereto and rotatable around the center axis of the screenplate, the fiber pulp being fed parallel with the center axis of the screenplate to baffle blade assembly comprising at least two baffle blades and also being rotatable around the center axis, wherein the speed of rotation of the baffle blade assembly and/or the radial dimension of the baffle blades are adjustable to control the screening. The invention additionally relates to pressurized screening devices for implementing the method.

13 Claims, 2 Drawing Sheets

METHOD FOR CONTROLLING PRESSURIZED SCREENING DEVICES AND PRESSURIZED SCREENING DEVICE

BACKGROUND OF THE INVENTION

The invention relates to a method for controlling pressurized screening devices in which fibre pulp is fed into the pressurized screening device and classified by means of a perforated screenplate into the accepted portion passing through the perforations of the screenplate and into the rejected portion which is removed from the screenplate. The perforated screenplate is treated by means of a device movable with respect thereto. The screenplate is cylindrical and the device for treating it rotates around the center axis of the screenplate.

Several different designs for pressurized screening devices of this kind are known, for instance, reference can be made to patent publications FI-56451 and FI-70059.

In screening, the purity of the accepted pulp and the capacity of the pressurized screening device are affected by the screenplate and by the device which moves relative to the screenplate and treats it. Perforation size in the screenplate has influence on both the capacity and the purity of the accepted portion. Also the surface profile, for example being profiled or smooth, has influence on the same quantities. The function of the device treating the screenplate, often called in technical language as the rotor, is to keep the screenplate clean, that is to break the fibre mat formations on its surface.

Experiments have shown that, in screening devices, the tangential velocity of the fibre pulp to be screened has a major effect on the capacity and the purity of the accepted fibre pulp. Experiments have revealed that, if the tangential velocity of the fibre pulp in the pressurized screening device approaches zero, the capacity of the pressurized screener will be high and the screening result will be poor. If, on the other hand, the tangential velocity of the fibre pulp in the pressurized screening device corresponds closely to that of the device (rotor) treating the screenplate, the capacity will become low and the screening result will become better.

The most common design of prior art is such that the fibre pulp in the screening device rotates much slower than the device (rotor) treating the screenplate. Situation becomes even worse in such pressurized screening devices where the tangential velocity of the fibre pulp varies in different parts of the screenplate, this effect becomes particularly crucial in the vertical direction of the screenplate in most designs of the pressurized screening devices presently in use. Therefore, the flow dynamics inside the pressurized screening device is unknown and indefinite. The situation in pressurized screening devices according to prior art is such that the tangential velocity of the fibre pulp is under control only in such pressurized screening devices where the pulp is forced to rotate along with the device (rotor) treating the screenplate.

SUMMARY OF THE INVENTION

The method and the pressurized screening device exploiting the method are designed to provide controlled tangential velocity of the fibre pulp relative to the velocity of the devices treating the screenplate (rotor), particularly relative to the velocity of the rotor scrapers. Application of the method of this invention enables one to always choose the most favorable capacity/quality ratio of screening for the process. In other words, the method according to the invention enables one to control the separating efficiency and/or the capacity in an optimal way necessary for the process. The accomplish the above objects the method according to the invention is primarily characterized in that fibre pulp is fed essentially parallel to the centre line of the screenplate to a baffle blade assembly comprising two or more baffle blades, that the baffle blade assembly is designed to rotate essentially round the center line and that the speed of rotation of the plurality of baffle blades and/or the radial dimension of the baffle blades is controlled.

The technical procedure described above provides a wide-ranging control action which enables one to control within wide limits the tangential velocity of the fibre pulp leaving the baffle blade assembly.

The object of the invention is also a pressurized screening device.

BRIEF DESCRIPTION OF THE DRAWINGS

The invention is further illustrated in the following description wherein reference is made to the enclosed drawings in which.

DETAILED DESCRIPTION OF THE PREFERRED EMBODIMENT(S)

Figure 1:
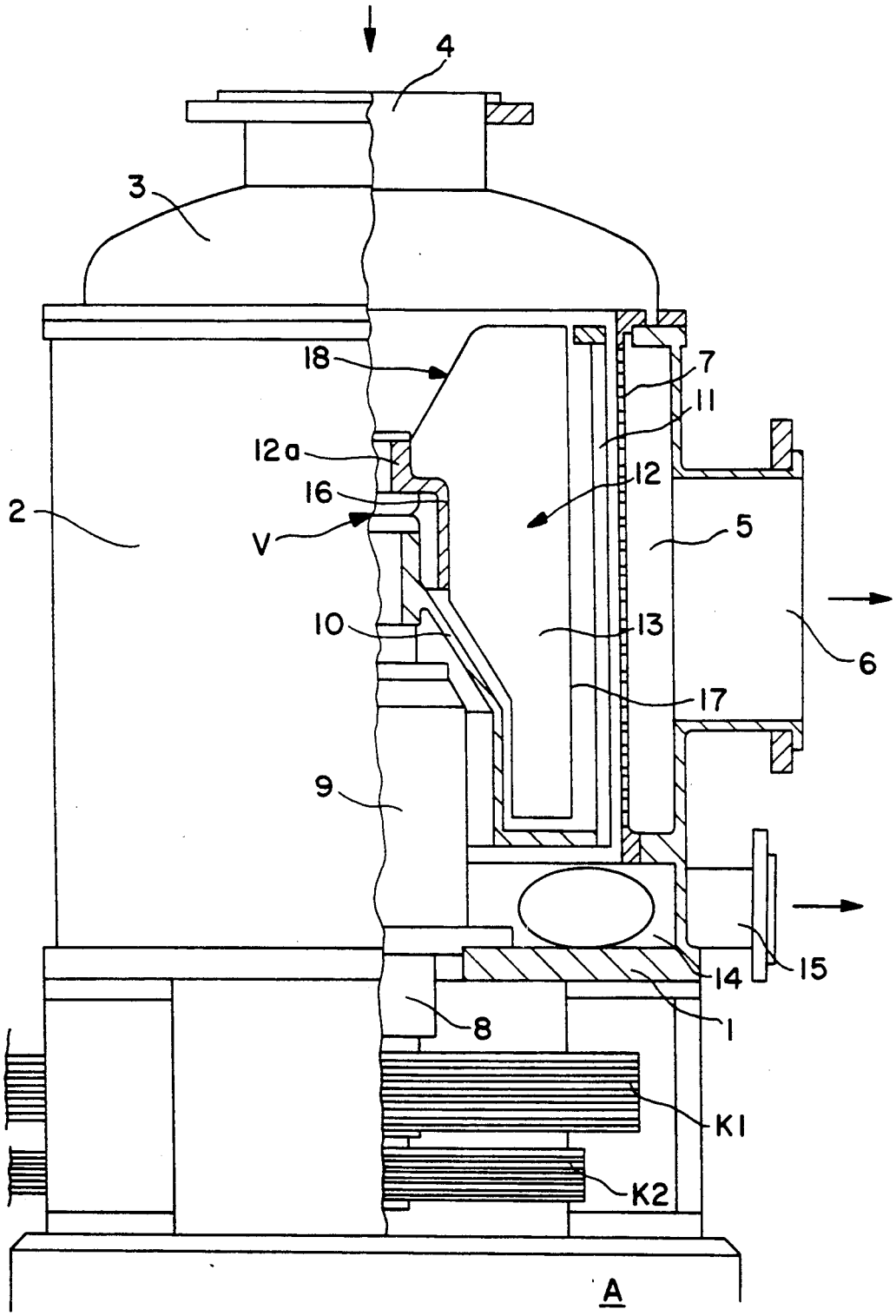
FIG. 1 shows a vertical cross-section, of one embodiment of pressurized screening devices exploiting the method according to the invention.
Figure 2:
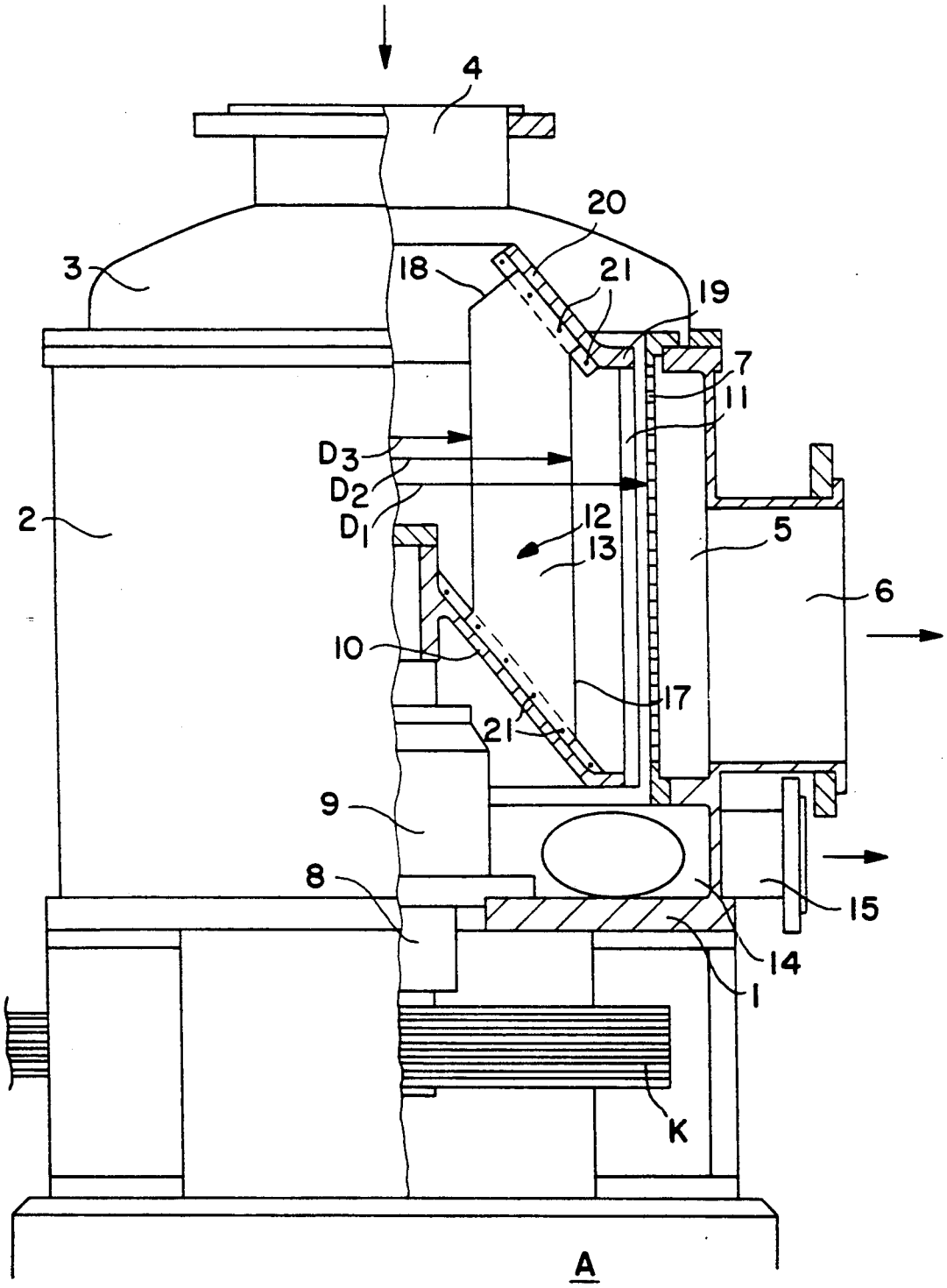
FIG. 2 shows a shows second embodiment of pressurized screening devices exploiting the method according to the invention.

The pressurized screening devices of FIGS. 1 and 2 are mounted on bed A and comprise bottom 1 and an uprightly directed cylindrical housing 2 with a cover 3 in the upper part. The cover includes a feed connection unit 4 in the center of the cylinder. The outer part of housing 2 is provided with an annular space 5 for the accepted portion of the fiber pulp, the space extending essentially the height of the housing. The annular space has a connection unit 6 for removing the accepted portion out of the pressurized screening device to the next process stage. The inner wall of the annular space 5 is formed by the cylindrical screenplate 7 provided with perforations. The shaft assembly 8 mounted on bearings 9 on bed 1 and designed to rotate around the center axis of the pressurized screening device extends through bed 1. The shaft assembly 8 rotates round the center axis of screenplate 7. A closed supporting structure 10, being at least partly conical, has been attached to its end. The supporting structure enlarges from shaft assembly 8 starting from the narrow end, which is directed to the feed connection unit, towards bed 1. Elements 11, which treat screenplate 7 and which include elongated parts, are attached to the wider edge of the conical supporting structure 10 at predetermined intervals along its circumference. Between bed 1 and the supporting structure 10 is a space 14 is formed for the rejected portion the fiber pulp. The space connects to connection unit 15 for removing the rejected portion from the pressurized screening device.

The baffle blade assembly 12 consists of a number of baffle blades 13 whose inner edge 16 within its middle is attached to the body of the baffle blade assembly 12*a*, the body, in turn, being attached to the shaft assembly 8 (FIG. 1) or to the supporting structure 10 and to the radial supporting arms 20 (FIG. 2). Baffle blades 13 are directed radially outward towards the screenplate 7. The outer edge 17 of the baffle blades 13 is substantially parallel with the screenplate. The edge, that is nearest to the feed connection unit 4, of the baffle blades is beveled outward from the center line (point 18, in FIGS. 1 and 2).

The embodiment shown in FIG. 1 is so designed that devices 11 and the baffle blade assembly 12 are provided with separate driving mechanisms, such as belt transmission K1 for devices 11 and belt transmission K2 for the baffle blade assembly 12 whereupon preferably a common driving mechanism like a combination of an electric motor, clutch and cone belt pulley drives the two concentric shafts indicated by number 8 in FIG. 1 the number referring generally to the shaft system. It is obvious that a construction performing the corresponding functions can be accomplished also by means of a clutch mounted at position V in the embodiment shown in FIG. 1 and wherefore only one driving mechanism along with the shaft is needed. In this case the baffle blade assembly 12 can, in the first place, be locked non-rotating relative to the pressurized screening device whereupon the tangential velocity of the fibre pulp is nearly zero when it leaves the outer edges 17 of baffle blade 13 of the baffle blade assembly 12. This can be accomplished, if necessary, so that the part of the shaft assembly 8 which drives the baffle blade assembly 12 is released from the driving mechanism and is locked relative to the pressurized screening device or so that the gear (point V, FIG. 1) which transmits the rotational force to the devices 11 is detached from the shaft assembly 8 and the baffle blade assembly 12 is locked in place so that it is immobile relative to the pressurized screening device. By the above arrangement the tangential velocity of the fibre pulp can be controlled while the pressurized screening device is in operation, in other words it is a so-called controllable pressurized screening device. Rotation of the baffle blade assembly 12 can be slowed down or speeded up and then, naturally, the tangential velocity of the fibre pulp is affected as it leaves the plurality of baffle blades. Naturally, the overall screening performance can also be controlled simultaneously or by separate measures by changing the rotational speed of devices 11. These measures can be accomplished, for instance, by means of an outside break mechanism or a drive mechanism.

In the embodiment of FIG. 2 the baffle blade assembly 12 is connected to the supporting structure 10 on one hand and to the supporting ring 19 on the radial supporting arms 20 on the other hand, the supporting arm being placed on the upper edge of the devices 11 for treating screenplate 7. The inner edges 16 of the baffle blades can, as in this case, be substantially parallel with the outer edges. In the embodiment of FIG. 2 the radial dimension of the baffle blades of the baffle blade assembly 12 can be changed by attaching the baffle blades to different radial positions in the supporting structure 10 and by means of fastening elements 21, such as guide bars provided with holes for bolt joints. In the embodiment of FIG. 2 the velocity ratio is arranged fixed since the baffle blade assembly 12 rotates along with the device 11 with a rotational velocity determined by the driving mechanism K, such as the cone belt transmission of the shaft assembly 8. The driving mechanism K is driven by an aggregate, such as the combination of an electric motor and a cone belt pulley (not shown).

This solution can be further clarified by the following calculation: Denoting $D_1$ = the cross-sectional diameter of the screenplate $D_2$ = diameter of the circle defined by the outer edges of the baffle blade assembly 12 and $D_3$ = diameter of the circle defined by the inner edges 16 of the baffle blade assembly, for instance $D_2 = 0{,}4 \ldots 0{,}7 * D_1$ and $D_1$ = approx. $0{,}2\text{–}0{,}3 * D_1$, then as fibre pulp which is to be screened is introduced into the middle part of the plurality of baffle blades (into the space with diameter $D_3$) and as the pulp passes by the baffle blades 13 of the baffle blade assembly 12 the pulp flow gains a maximum tangential velocity, depending, for example, on losses, $$V_{t2} \approx N * \pi * D_2,$$

where

N = speed of rotation (1/s) and $D_2$ = diameter in meters.

When this fibre pulp reaches screenplate 7 it has maintained the velocity $V_{t2}$ which is clearly less than the velocity of the devices 11 (the rotor blades) for treating the screenplate $$V_{t1} = N * \pi * D_1,$$

since $D_2$ is smaller than $D_1$.

This shows clearly that by changing the ratio $D_2/D_1$ one can change the ratio of the tangential velocity of the fibre pulp to the velocity of the devices for treating the screenplate 7. As $D_2$ approaches $D_1$ one arrives at a situation where the tangential velocity of fibre pulp as it leaves the baffle blade assembly 12 approaches the velocity of the devices for treating the screenplate 7.

It is obvious that embodiments of FIGS. 1 and 2 can be united into the same pressurized screening device within the alternative embodiments of the basic idea of the invention.

We claim:

1. Method for controlling a single phase pressurized screening device for screening a fiber pulp into an accepted portion passing through perforations of a perforated cylindrical screenplate and into a rejected portion which is removed from the screenplate, the perforated screenplate being treated by a treating device which includes a supporting structure and is movable along with the supporting structure with respect to the screenplate and rotatable around a center axis of the screenplate, said method comprising the steps of:

feeding said fiber pulp substantially parallel with the center axis of the screenplate to a baffle blade assembly located inside the volume which is defined by the bottom of said supporting structure of the treating device and in the vertical direction by the path of motion of the treating device, the baffle blade assembly including at least two baffle blades, the front edges of which facing the screenplate are parallel with the screenplate, said baffle blade assembly being rotatable substantially around said central axis; and controlling screening of the fiber pulp by adjusting tangential velocity of the fiber pulp leaving said front edges of the baffle blades substantially towards the screenplate through the area defined by the path of motion of the treating device by changing at least one of the following:

a) the speed of rotation of the baffle blade assembly; and b) the radial position of the baffle blades of the baffle blade assembly relative to the screenplate.

2. Method according to claim 1, further including a step of connecting the baffle blade assembly and the movable device for treating the screenplate to separate driving mechanisms.

3. Method according to claim 1, further including a step of connecting the baffle blade assembly and the treating device to a common driving mechanism.

4. A pressurized screening device for single phase screening comprising:

a perforated screenplate placed inside a housing;

a device for treating the screenplate which is movable relative thereto;

means for generating the relative motion between the screenplate and the device for treating the screenplate;

a space into which the fiber pulp is fed, said space being defined in the vertical direction by the path of motion of said treating device and having a bottom defined by a supporting structure of said treating device; and piping means for: a) introducing fiber pulp into said space in the pressurized screening device, b) for removing the accepted portion of fiber pulp from the pressurized screening device, and c) for removing the rejected portion of fiber pulp from the pressurized screening device; and means for controlling tangential velocity of the fiber pulp relative to the velocity of said treating device, said means for controlling the tangential velocity including at least two baffle blades rotatable around an axis parallel with the center axis of the screenplate, said baffle blades each having a front edge facing the screenplate substantially parallel with said screenplate, said front edge being location inside said space and directed radially outwards towards the screenplate and the treating device.

5. A pressurized screening device according to claim 4, wherein the baffle blades and the movable device for treating the screenplate are provided with separate driving mechanisms to which both are separately connected.

6. A pressurized screening device according to claim 4, wherein the movable baffle blades are adapted to be lockable relative to the supporting structure of the treating device.

7. A pressurized screening device according to claim 4, wherein the supporting structure of the treating device comprises a supporting ring having a housing and radial supporting arms and being connected to the treating device, and a plurality of fastening means for locking the baffle blades with respect to the treating device through said supporting arms in a radial direction at selected positions.

8. A pressurized screening device according to claim 4, wherein the movable baffle blades are adapted to be lockable relative to the supporting structure of the treating device.

9. A pressurized screening device according to claim 4, wherein a gearing is placed between a body of the baffle blades and a driving mechanism common to the baffle blades and the treating device.

10. A pressurized screening device according to claim 4 wherein the baffle blades and the treating device are connected to a common driving mechanism.

11. A pressurized screening device according to claim 10, wherein the movable baffle blades are connected to the supporting structure of the treating device.

12. A pressurized screening device according to claim 10, wherein a gearing is placed between a body of the baffle blades and said driving mechanism common to the baffle blades and the treating device.

13. A pressurized screening device according to claim 10, wherein the supporting structure of the treating device further comprises a supporting ring having a housing and radial supporting arms and being connected to the treating device, and a plurality of fastening means for locking the baffle blades with respect to the treating device through said supporting arms in a radial direction at selected positions.

* * * * *